US006265965B1

(12) United States Patent
Lee

(10) Patent No.: US 6,265,965 B1
(45) Date of Patent: Jul. 24, 2001

(54) COMMUNICATION BUZZER

(76) Inventor: Soo Hyung Lee, 1010-701, Kummaul, Apt., 1104, Joong-2-dong, Wonmiku, Bucheonsi Kyonggido (KR)

( * ) Notice: Subject to any disclaimer, the term of this patent is extended or adjusted under 35 U.S.C. 154(b) by 0 days.

(21) Appl. No.: 09/250,434

(22) Filed: Feb. 16, 1999

(30) Foreign Application Priority Data

Feb. 16, 1998 (KR) ..... 98-4624
Sep. 25, 1998 (KR) ..... 98-39895
Dec. 24, 1998 (KR) ..... 98-57997

(51) Int. Cl.[7] ..... G10K 9/00

(52) U.S. Cl. ..... 340/388.1; 340/384.1; 340/311.1; 340/407.1; 340/391.1; 340/825.5; 381/417; 381/412; 381/395; 381/396; 381/398; 381/431

(58) Field of Search ..... 381/417, 398, 381/396, 395, 431, 403, 407, 412; 340/388.1, 384.1, 311.1, 407.1, 391.1, 825.5

(56) References Cited

U.S. PATENT DOCUMENTS 5,528,697 * 6/1996 Saito ..... 381/192
5,953,437 * 9/1999 Imahori et al. ..... 381/417
5,960,096 * 9/1999 Imahori et al. ..... 381/417
5,974,157 * 10/1999 Tajima et al. ..... 381/354

* cited by examiner

*Primary Examiner*—Jeffery Hofsass
*Assistant Examiner*—Hung Nguyen
(74) *Attorney, Agent, or Firm*—Staas & Halsey LLP

(57) ABSTRACT

Disclosed is a communication buzzer. The communication buzzer comprises a nonconductive magnetic piece having substantially a cup-shaped configuration so that it possesses a bottom wall portion and a main wall portion which extends upward from the bottom wall portion; a magnetizable shaft securely fixed to the bottom wall portion of the nonconductive magnetic piece and projecting upward and concentrically with the main wall portion of the nonconductive magnetic piece; an electromagnetic actuator fitted around the magnetizable shaft for magnetizing the magnetizable shaft when current is supplied thereto and for demagnetizing the magnetizable shaft when a current supply is shut off; a conductive piece for providing a current path connected to the electromagnetic actuator, the conductive piece having a first end exposed to the outside, a second end brought into contact with the electromagnetic actuator and a middle portion extending through the bottom wall portion of the nonconductive magnetic piece; and a vibrating plate separated by a predetermined distance from an upper end of the magnetizable shaft, the vibrating plate vibrating as the magnetizable shaft is repeatedly magnetized and demagnetized, thereby generating a sound wave.

3 Claims, 5 Drawing Sheets

COMMUNICATION BUZZER

BACKGROUND OF THE INVENTION

1. Field of the Invention

The present invention relates to a communication buzzer, and more particularly, the present invention relates to a communication buzzer which is used in a communication device such as a portable phone, a beeper or the like, to inform of the reception of an incoming call.

2. Description of the Related Art

Generally, a direct current buzzer used in a small-sized communication device functions to inform of the reception of an incoming call The direct current buzzer serves as an essential component of a communication device such as a portable phone, a beeper or the like. Recently, as communication devices continue the trend toward structural miniaturization in view of portability or convenience for use, components thereof have also been gradually miniaturized.

Referring to FIG. 1, there is shown a cross-sectional view which illustrates a structure of a communication buzzer according to the related art. The direct current communication buzzer 11 includes a printed circuit board (PCB) 2 which has a lead wire 1. A base plate 3 is put onto an upper surface of the printed circuit board 2. A shaft 4 is mounted to a center portion of the printed circuit board 2 and base plate 3 such that it projects upward through them. Electromagnetic actuating means 5 is fitted around the shaft 4 which projects upward. As an example, a core prepared by winding a coil around an iron-core is used as the electromagnetic actuating means 5. Both ends of the electromagnetic actuating means 5 are connected to positive and negative electrodes of the printed circuit board 2, respectively, by means of soldering, etc.

On an upper surface of the base plate 3, a magnetic piece 6 is disposed around the electromagnetic actuating means 5 such that it is separated therefrom by a predetermined radial distance. Also, a vibrating plate support member 7 having a cylindrical configuration is arranged on an edge portion of the base plate 3 such that it surrounds the magnetic piece 6. A vibrating plate 8 is seated onto a shoulder which is formed adjacent an upper end of a circumferential inner surface of the vibrating plate support member 7. Finally, an outer case 9 is fitted around the vibrating plate support member 7 such that it closes an upper end thereof, and a packing material is filled into a gap between the vibrating plate support member 7 and the printed circuit board 2 thereby to construct a complete communication buzzer 11.

In the communication buzzer 11 constructed as mentioned above, as the vibrating plate 8 is vibrated, a sound wave is generated as described below. First, magnetic force generated by the magnetic piece 6 is absorbed by the base plate 3 which is made of metallic material, and then, is transferred to the shaft 4. The shaft 4 which receives the magnetic force through the base plate 3, attracts and curves the vibrating plate 8 downward. In this state, as current is applied to the printed circuit board 2 through the lead wire 1, the shaft 4 is magnetized through the electromagnetic actuating means 5 to further attract and curve the vibrating plate 8 downward. Thereafter, as the current applied to the printed circuit board 2 is momentarily shut off, the vibrating plate 8 which is attracted and curved downward, is returned to its original curved position.

Accordingly, by repeatedly and alternately performing a current supply operation and a current shut-off operation, the vibrating plate 8 is vibrated while being further curved downward and being returned to its original curved position, thereby generating a sound wave.

However, the communication buzzer 11 of the related art suffers from defects in that since the current supplied to the electromagnetic actuating means 5 can leak through the conductive base plate 3, the separate printed circuit board 2 must be necessarily used, and by this, manufacturing cost is increased and assembling time for assembling the printed circuit board 2 and the base plate 3 is lengthened.

In particular, due to the fact that the communication buzzer 11 of the related art has a number of components, assembling time is further lengthened and miniaturization of an end product is considered to be difficult. That is, in order to miniaturize a communication buzzer and shorten assembling time, sizes of components must be decreased and the whole structure of the communication buzzer must be simplified. Nevertheless, in the communication buzzer 11 of the related art, since the printed circuit board 2 and the base plate 3 are assembled with each other, the shaft 4 is mounted to the printed circuit board 2 and the base plate 3, the electromagnetic actuating means 5 and the magnetic piece 6 are disposed on the upper surface of the base plate 3 such that they are spaced apart from each other by the predetermined radial distance, and the vibrating plate support member 7 for arranging the vibrating plate 8 is separately fabricated and fitted around the magnetic piece 6, the number of components is increased and assembling procedure is complicated, thereby lengthening assembling time and setting limits to the miniaturization of the components.

Moreover, when the radial distance between the electromagnetic actuating means 5 and the magnetic piece 6 does not kept constant, the vibrating plate support member 7 is apt to be deviated from a center of the shaft 4. If the vibrating plate support member 7 is deviated, because the vibrating plate 8 is also deviated from the center of the shaft 4, reliable operation of the vibrating plate 8 cannot be ensured. Therefore, assembling operation of the communication buzzer must be carefully performed, by which assembling time is further lengthened and productivity is deteriorated.

In addition, while a distance between an upper end of the shaft 4 and the vibrating plate 8 should be kept constant, in the communication buzzer of the related art, since the shaft 4 is mounted to the printed circuit board 2 and the base plate 3 by being squeezed against them through a press, an assembling error may be caused. Accordingly, a constant distance between the upper end of the shaft 4 and the vibrating plate 8 cannot be ensured.

SUMMARY OF THE INVENTION

Accordingly, the present invention has been made in an effort to solve the problems occurring in the related art, and a primary object of the present invention is to provide a communication buzzer which has a simple structure thereby to reduce the number of components, whereby cutting down manufacturing cost, shortening assembling time and improving productivity.

Another object of the present invention is to provide a communication buzzer which can ensure assembling precision, minimize the number of components and be miniaturized in size.

According to one aspect of the present invention, there is provided a communication buzzer comprising: a nonconductive magnetic piece having substantially a cup-shaped configuration so that it possesses a bottom wall portion and a main wall portion which extends upward from the bottom wall portion; a magnetizable shaft securely fixed to the bottom wall portion of the nonconductive magnetic piece and projecting upward and concentrically with the main wall portion of the nonconductive magnetic piece; an electromagnetic actuator fitted around the magnetizable shaft for magnetizing the magnetizable shaft when current is supplied thereto and for demagnetizing the magnetizable shaft when a current supply is shut off; a conductive piece for providing a current path connected to the electromagnetic actuator, the conductive piece having a first end exposed to the outside, a second end brought into contact with the electromagnetic actuator and a middle portion extending through the bottom wall portion of the nonconductive magnetic piece; and a vibrating plate separated by a predetermined distance from an upper end of the magnetizable shaft, the vibrating plate vibrating as the magnetizable shaft is repeatedly magnetized and demagnetized, thereby generating a sound wave.

According to another aspect of the present Invention, there is provided a communication buzzer comprising: a nonconductive magnetic piece having a bottom wall portion which possesses a through hole and a main wall portion which extends upward from the bottom wall portion; a magnetizable center member having a base portion which is securely fixed to the bottom wall portion of the nonconductive magnetic piece such that it closes the through hole of the bottom wall portion and a shaft portion which projects upward from the base portion; an electromagnetic actuator fitted around the shaft portion of the magnetizable center member for magnetizing the magnetizable center member when current is supplied thereto and for demagnetizing the magnetizable center member when a current supply is shut off; a conductive piece for providing a current path connected to the electromagnetic actuator, the conductive piece having a first end exposed to the outside, a second end brought into contact with the electromagnetic actuator and a middle portion extending through the nonconductive magnetic piece; and a vibrating plate separated by a predetermined distance from an upper end of the shaft portion of the magnetizable center member, the vibrating plate vibrating as the magnetizable center member is repeatedly magnetized and demagnetized, thereby generating a sound wave.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
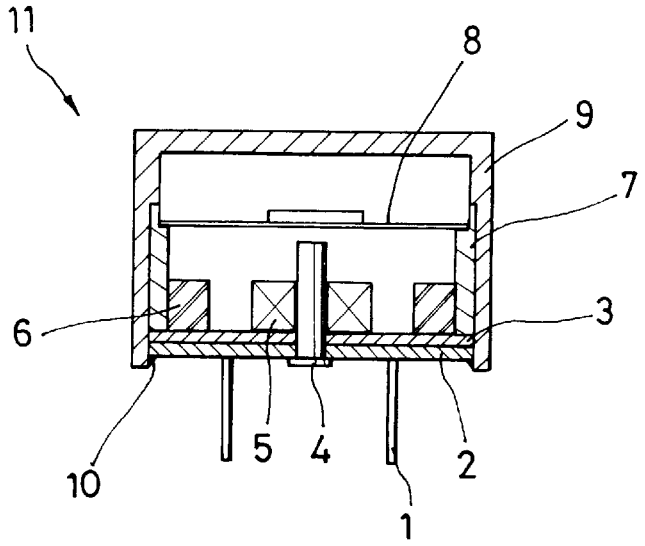
FIG.1 (PRIOR ART)
FIG. 1 is a cross-sectional view illustrating a structure of a communication buzzer according to the related art.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
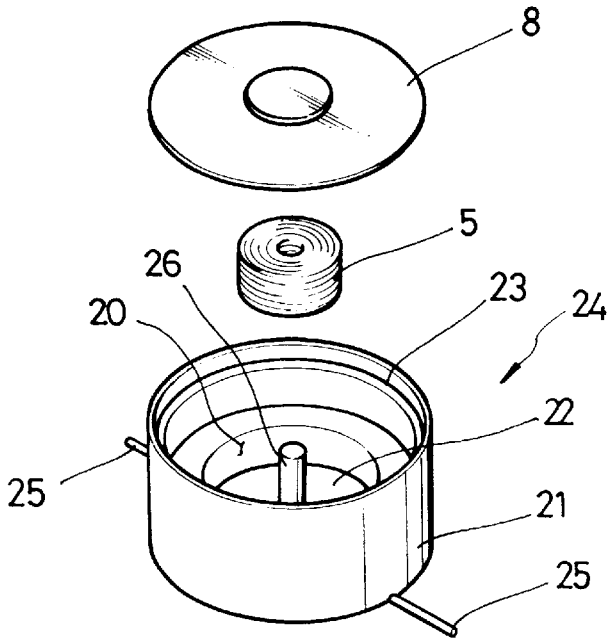
FIG. 2 is an exploded perspective view illustrating a structure of a communication buzzer in accordance with an embodiment of the present invention.
Figure 3:
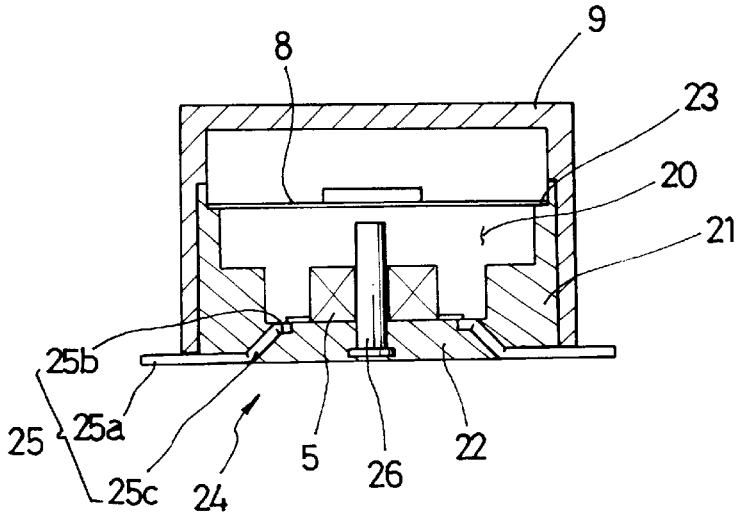
FIG. 3 is a cross-sectional view illustrating the communication buzzer of FIG. 2, which is in an assembled state.
Figure 4:
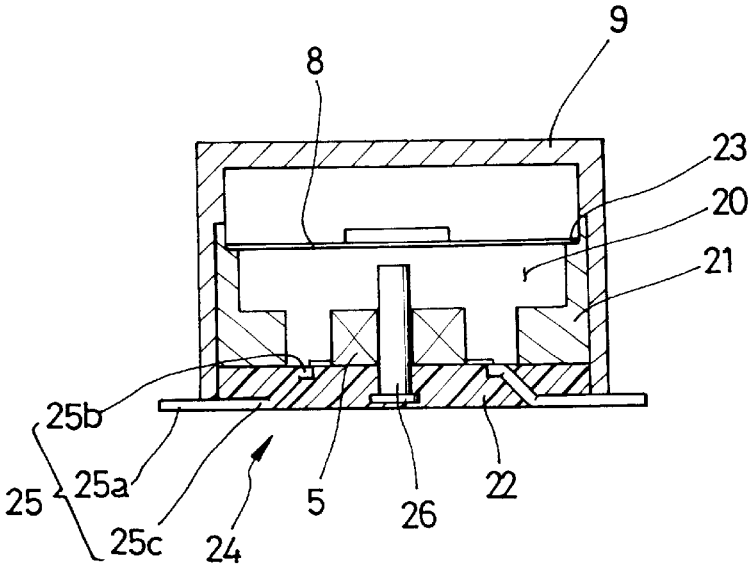
FIG. 4 is a cross-sectional view illustrating a structure of a communication buzzer in accordance with another embodiment of the present invention.

Referring to FIG. 2, there is shown an exploded perspective view which illustrates a structure of a communication buzzer in accordance with an embodiment of the present invention. FIG. 3 is a cross-sectional view illustrating the communication buzzer of FIG. 2, which is in an assembled state, and FIG. 4 is a cross-sectional view illustrating a structure of a communication buzzer in accordance with another embodiment of the present invention.

As shown in the drawings, a communication buzzer according to the present invention includes a magnetic piece 24 which has substantially a cup-shaped configuration. The magnetic piece 24 comprises a nonconductive magnet pellet which is made of strontium ferrite and polyphenylene sulfide. The magnetic piece 24 possesses a main wall portion 21 and a bottom wall portion 22. The bottom wall portion 22 constitutes a lower part of the magnetic piece 24, and the main wall portion 21 is integrally formed on an edge part of the bottom wall portion 22 such that it extends upward. A shoulder 23 is formed adjacent an upper end of a circumferential inner surface of the main wall portion 21 of the magnetic piece 24, and a shaft 26 is mounted to the bottom wall portion 22 of the magnetic piece 24 such that it projects upward therethrough. A lower part of the shaft 26 is embedded into the bottom wall portion 22 to be fixedly secured thereto while being concentrically aligned with the main wail portion 21. The shaft 26 can be magnetized by the magnetic piece 24.

On the bottom wall portion 22, electromagnetic actuating means 5 is fitted around the shaft 26 to magnetize and demagnetize the shaft 26 relying upon whether current is supplied thereto or not. As an example, a core prepared by winding a coil around an iron-core may be used as the electromagnetic actuating means 5.

The magnetic piece 24 is provided with a conductive piece 25 which defines a current path connected to the electromagnetic actuating means 5. The conductive piece 25 is integrally molded with the bottom wall portion 22 of the magnetic piece 24. The conductive piece 25 has a first end 25*a* which is exposed to the outside, a second end 25*b* which is brought into contact with the electromagnetic actuating means 5 and a middle portion 25*c* which transversely extends through the bottom wall portion 22 of the magnetic piece 24. The conductive piece 25 functions to magnetize and demagnetize the shaft 26 by applying current to and shutting-off a current supply to the electromagnetic actuating means 5, respectively.

On the other hand, a vibrating plate 8 is seated onto the shoulder 23 which is formed adjacent the upper end of the circumferential inner surface of the main wall portion 21, such that it is separated from an upper end of the shaft 26 by a predetermined distance. The vibrating plate 8 generates a sound wave as the shaft 26 is repeatedly magnetized and demagnetized. Finally, an outer case 9 is fitted around the main wall portion 21 of the magnetic piece 24 such that it closes an upper end of the magnetic piece 24. According to this, a closed vibrating room 20 is defined in the magnetic piece 24.

In the meanwhile, as shown in FIG. 4, the magnetic piece 24 may have the main wall portion 21 and the bottom wall portion 22 which are separately molded from each other and bonded by adhesive means at a contact surface therebetween. At this time, it is to be readily understood that the adhesive means should be made of magnetic material so that it can transmit magnetic force between the bottom wall portion 22 and the main wall portion 21.

Hereinafter, operations of the communication buzzer of the present invention, constructed as mentioned above, will be described in detail. First, the shaft 26 is caused to have magnetism by a magnetic field formed by the magnetic piece 24. The shaft 26 having magnetism attracts the vibrating plate 8 thereby to always curve it downward. In this state, as current is applied to the electromagnetic actuating means 5 through the conductive piece 25, the shaft 26 is magnetized, and at the same time, further attracts the vibrating plate 8 downward. Then, as the current applied to the electromagnetic actuating means 5 is momentarily shut off, the shaft 26 is demagnetized, and the vibrating plate 8 which is attracted and curved downward is returned to its original curved position. Accordingly, by repeatedly and alternately performing a current supply operation and a current shut-off operation, the vibrating plate 8 is vibrated while being further curved downward and being returned to its original curved position, thereby generating a sound wave.

Figure 5:
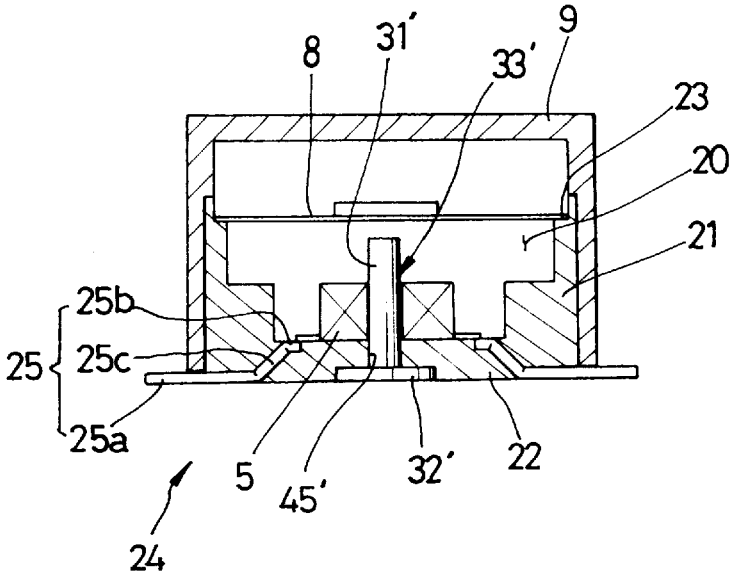
FIG. 5 is a cross-sectional view similar to FIG. 3 but having a modified shaft as a structural element of the communication buzzer according to the present invention.
Figure 6:
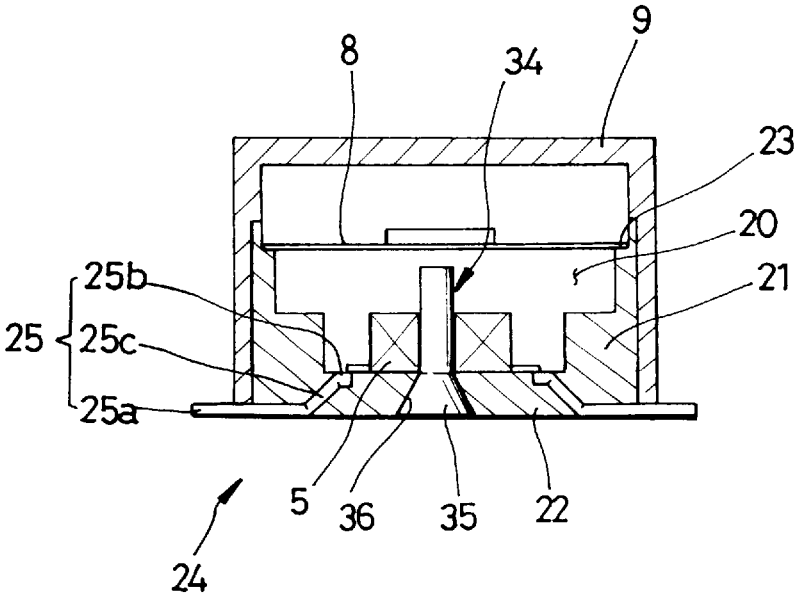
FIG. 6 is a cross-sectional view similar to FIG. 3 but having another modified shaft as a structural element of the communication buzzer.
Figure 7:
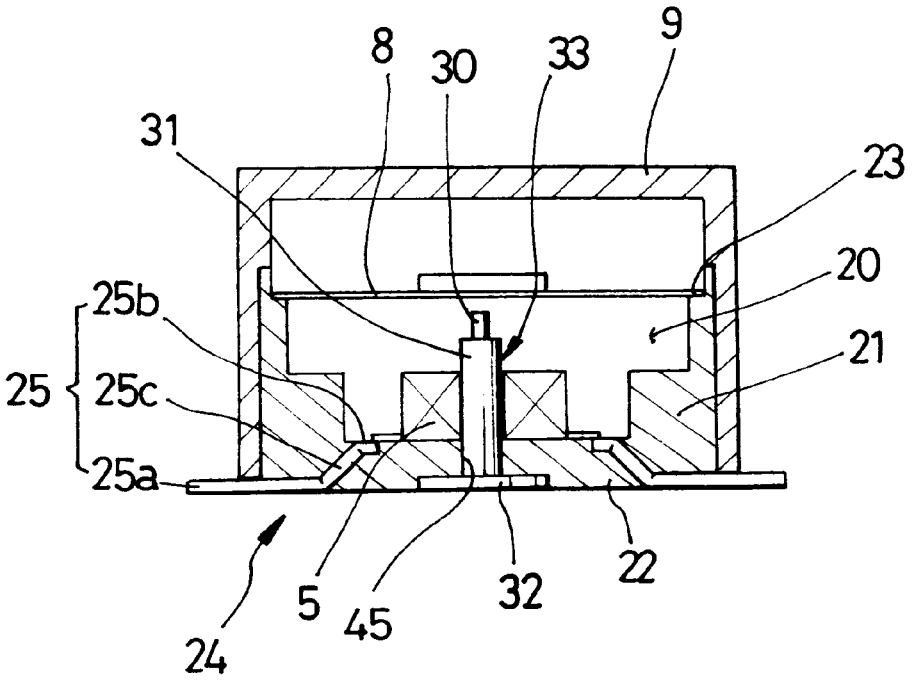
FIG. 7 is a cross-sectional view similar to FIG. 3 but having still another modified shaft as a structural element of the communication buzzer.

Referring to FIG. 5, there is shown a cross-sectional view similar to FIG. 3 but having a modified shaft as a structural element of the communication buzzer according to the present invention. FIG. 6 is a cross-sectional view similar to FIG. 3 but having another modified shaft as a structural element of the communication buzzer, and FIG. 7 is a cross-sectional view similar to FIG. 3 but having still another modified shaft as a structural element of the communication buzzer.

As shown in FIG. 5, a shaft 33' which is modified according to the present invention, is formed such that it has a stepped configuration. The stepped shaft 33' has a head portion 32' which has a disk-shaped configuration and is partially embedded into the bottom wall portion 22 of the magnetic piece 24 and a shank portion 31' which extends upward from the head portion 32' through the electromagnetic actuating means 5. The head portion 32' has a diameter which is larger than that of the shank portion 31'. This is because a supporting area for the head portion 32' which is embedded into the bottom wall portion 22 of the magnetic piece 24 should be as wide as possible to secure stability thereof and a contact area between the bottom wall portion 22 and the head portion 32' should also be as wide as possible o greatly absorb magnetic force.

On the other hand, while the stepped shaft 33' can be integrally formed with the magnetic piece 24 as described above, it is also possible that the bottom wall portion 22 of the magnetic piece 24 is formed with a hole 45' through which the shank portion 31' can be tightly passed and a recess into which the head portion 32' can be received. The shank portion 31' of the stepped shaft 33' is inserted through the hole 45' form bottom to top of the magnetic piece 24. At this time, it is of course to be readily understood that the hole 45' is formed in the magnetic piece 24 such that it is aligned on a true center of the bottom wall portion 22 of the magnetic piece 24 thereby to prevent the stepped shaft 33' from being deviated from the vibrating plate 8.

In FIG. 6, a head portion 35 of a shaft 34 is formed such that it has a frusto-conical configuration. The head portion 35 having the frusto-conical configuration is embedded into the bottom wall portion 22 of the magnetic piece 24. While the head portion 35 can be integrally formed with the magnetic piece 24, it is also possible that the bottom wall portion 22 of the magnetic piece 24 may be formed with a frusto-conical hole 36 through which the shaft 34 is inserted from bottom to top of the magnetic piece 24. The shaft 34 having the frusto-conical head portion 35 is structured such that it is aligned on the true center of the magnetic piece 24, as described above.

Referring to FIG. 7, a shaft 33 has substantially a stepped configuration as in FIG. 5. The shaft 33 which is further modified according to the present invention, has a head portion 32 which has a disk-shaped configuration and is partially embedded into the bottom wall portion 22 of the magnetic piece 24, a shank portion 31 which extends upward from the head portion 32 through the electromagnetic actuating means 5, and a tail-end portion 30 which extends upward from an upper end of the shank portion 31 toward the vibrating plate 8. The head portion 32 has a diameter which is larger than that of the shank portion 31, and the shank portion 31 has the diameter which is larger than that of the tail-end portion 30. This is because a supporting area for the head portion 32 which is embedded into the bottom wall portion 22 of the magnetic piece 24 should be as wide as possible to secure stability thereof and a contact area between the bottom wall portion 22 and the head portion 32 should also be as wide as possible to greatly absorb magnetic force. Further, this is because a diameter of the shaft 33 should be gradually decreased from the shank portion 31 toward the tail-end portion 30 to amplify intensity of magnetic force transferred to the vibrating plate 8.

On the other hand, while the stepped shaft 33 can be integrally formed with the magnetic piece 24, it is also possible that the bottom wall portion 22 of the magnetic piece 24 is formed with a hole 45 through which the shank portion 31 can be tightly passed and a recess into which the head portion 32 can be received. The shank portion 31 of the stepped shaft 33 is inserted through the hole 45 from bottom to top of the magnetic piece 24. At this time, it is of course to be readily understood that the hole 45 is formed in the magnetic piece 24 such that it is aligned on a true center of the bottom wall portion 22 of the magnetic piece 24 thereby to prevent the stepped shaft 33 from being deviated from the vibrating plate 8.

As described above, in the communication buzzer of the present invention, the shafts 26, 33', 33 and 34 are precisely aligned on the true center of the bottom wall portion 22 of the magnetic piece 24 and the vibrating plate 8 is precisely seated onto the shoulder 23 formed adjacent the upper end of the circumferential inner surface of the magnetic piece 24, whereby the communication buzzer of the present invention can be precisely and promptly assembled. Also, due to the fact that the shafts 26, 33', 33 and 34 are assembled on the true center of the bottom wall portion 22 of the magnetic piece 24, a radial distance between the electromagnetic actuating means 5 and the main wall portion 21 of the magnetic piece 24 is kept constant, whereby a magnetic field can be uniformly induced.

Figure 8:
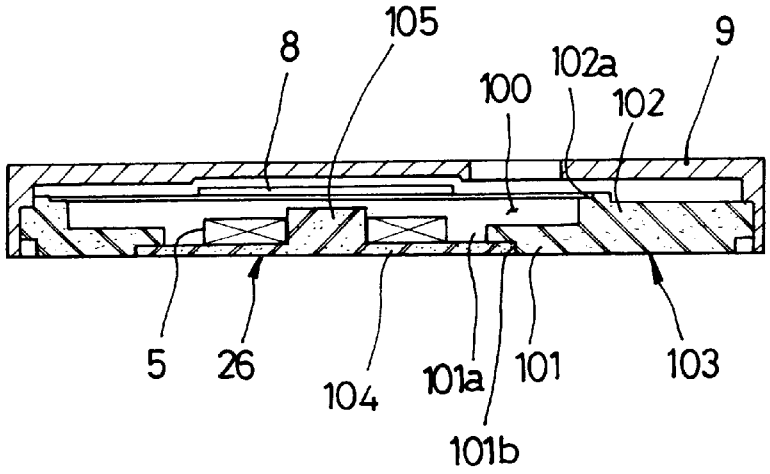
FIG. 8 is a cross-sectional view illustrating a structure of a communication buzzer in accordance with still another embodiment of the present invention.
Figure 9:
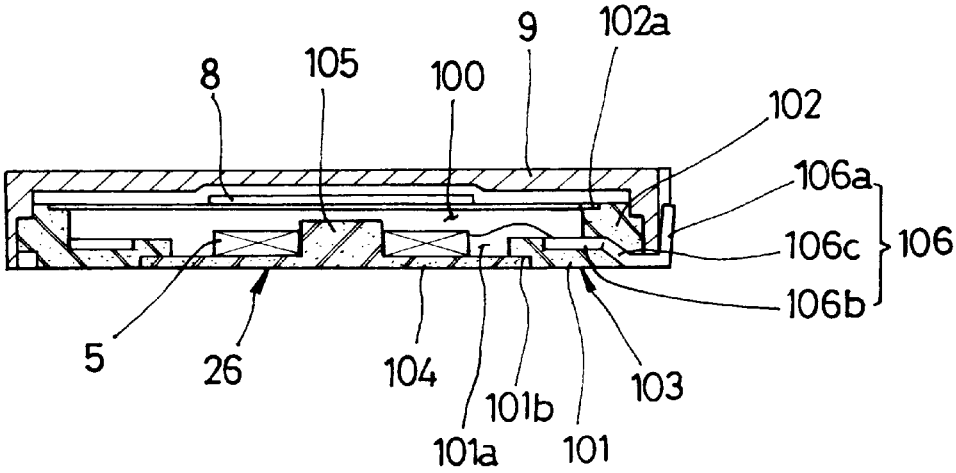
FIG. 9 is a side cross-sectional view of the communication buzzer of FIG. 8.

FIGS. 8 and 9 are cross-sectional views which illustrate a communication buzzer in accordance with still another embodiment of the present invention, in which respective components are minimized in their thickness to miniaturize a structure of the communication buzzer. The communication buzzer according to the present embodiment includes a nonconductive magnetic piece 103. The nonconductive magnetic piece 103 comprises a magnet pellet which is made of strontium ferrite and polyphenylene sulfide. The nonconductive magnetic piece 103 has a bottom wall portion 101 which possesses a central through hole 101*a* and a main wall portion 102 which extends upward from the bottom wall portion 101. The nonconductive magnetic piece 103 further has a lower seat 101*b* which is formed on a lower surface of the bottom wall portion 101 around the central through hole 101*a* and an upper seat 102*a* which is formed on an upper surface of the main wall portion 102 around a closed vibrating room 100.

A magnetizable center member 26 is fixedly secured to the bottom wall portion 101 of the nonconductive magnetic piece 103. The magnetizable center member 26 has a base portion 104 which is seated onto the lower seat 101*b* to close the central through hole 101*a* and a shaft portion 105 which projects upward from the base portion 104. Further, electromagnetic actuating means 5 is fitted around the shaft portion 105 to magnetize and demagnetize the magnetizable center member 26 relying upon whether current is supplied thereto or not. As an example, a core prepared by winding a coil around an iron-core may be used as the electromagnetic actuating means 5.

The nonconductive magnetic piece 103 is provided with a conductive piece 106 which defines a current path connected to the electromagnetic actuating means 5. The conductive piece 106 is integrally molded with the bottom wall portion 101 of the magnetic piece 103. The conductive piece 106 has a first end 106*a* which is exposed to the outside, a second end 106*b* which is brought into contact with the electromagnetic actuating means 5 and a middle portion 106*c* which transversely extends through the bottom wall portion 101 of the magnetic piece 103. The conductive piece 106 functions to magnetize and demagnetize the shaft portion 105 by applying current to and shutting-off a current supply to the electromagnetic actuating means 5, respectively.

On the other hand, a vibrating plate 8 is seated onto the upper seat 102*a* which is formed on the main wall portion 102, such that it is separated from an upper end of the shaft portion 105 by a predetermined distance. The vibrating plate 8 generates a sound wave as the shaft portion 105 is repeatedly magnetized and demagnetized. Finally, an outer case 9 is fitted around the main wall portion 102 of the magnetic piece 103 such that it closes an upper end of the magnetic piece 103. According to this, the closed vibrating room 100 is defined in the magnetic piece 103.

In the communication buzzer according to the present embodiment, constructed as mentioned above, a separate shaft is not provided in view of minimization of a thickness of the communication buzzer, but instead, the shaft portion 105 is integrally formed with the base portion 104 to complete the magnetizable center member 26. Further, in the present embodiment, the nonconductive magnetic piece 103, the outer case 9 and the electromagnetic actuating means 5 are minimized in their thickness to make the structure of the communication buzzer compact.

In the present embodiment, since the base portion 104 of the magnetizable center member 26 is seated onto the lower seat 101*b* of the nonconductive magnetic piece 103, the shaft portion 105 of the magnetizable center member 26 is precisely secured on a true center of the nonconductive magnetic piece 103. Due to the fact that the base portion 104 is seated onto the lower seat 101*b* and the vibrating plate 8 is seated onto the upper seat 102*a*, the communication buzzer of the present embodiment can be precisely and promptly assembled. On the other hand, since operations and working effects of the communication buzzer in accordance with the present embodiment are the same as those of the preceding embodiments, detailed statement thereof will be omitted.

As described above, a communication buzzer according to the present invention provides advantages in that since it has a simple structure thereby to reduce the number of components, manufacturing cost is cut down and assembling time is shortened, whereby productivity is improved.

Further, according to the present invention, assembling precision is ensured due to the fact that a shaft is integrally injection-molded on a true center of a magnetic piece which constitutes a lower part of the communication buzzer and the magnetic piece is formed with a shoulder onto which a vibrating plate is seated, whereby the possibility of an assemblage failure is lessened.

Moreover, because a magnetizable shaft and a shaft plate are integrally formed with each other without using a separate shaft, the number of components is reduced and at the same time, a structure of the communication buzzer is miniaturized.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A communication buzzer comprising:

a nonconductive magnetic piece having substantially a cup-shaped configuration so that it possesses a bottom wall portion and a main wall portion which extends upward from the bottom wall portion;

a magnetizable shaft securely fixed to the bottom wall portion of the nonconductive magnetic piece and projecting upward and concentrically with the main wall portion of the nonconductive magnetic piece;

electromagnetic actuating means fitted around the magnetizable shaft for magnetizing the magnetizable shaft when current is supplied thereto and for demagnetizing the magnetizable shaft when a current supply is shut off;

a conductive piece for providing a current path connected to the electromagnetic actuating means, the conductive piece having a first end exposed to the outside, a second end brought into contact with the electromagnetic actuating means and a middle portion extending through the bottom wall portion of the nonconductive magnetic piece;

a vibrating plate separated by a predetermined distance from an upper end of the magnetizable shaft, the vibrating plate vibrating as the magnetizable shaft is repeatedly magnetized and demagnetized, thereby generating a sound wave; and wherein the magnetizable shaft has a head portion which is at least partially embedded into the bottom wall portion of the nonconductive magnetic piece, a shank portion which extends upward from the head portion through the electromagnetic actuating means and has a diameter less than that of the head portion, and a tail-end portion which extends upward from the shank portion toward the vibrating plate and has a diameter less than that of the shank portion.

2. The communication buzzer as claimed in claim 1, further comprising:

an outer case closing an upper end of the main wall portion of the nonconductive magnetic piece for defining a closed vibrating room therein.

3. The communication buzzer as claimed in claim 1, wherein the conductive piece is integrally formed with the bottom wall portion of the nonconductive magnetic piece.

* * * * *